United States Patent [19]

Legeais

[11] Patent Number: 5,050,664

[45] Date of Patent: Sep. 24, 1991

[54] SECTIONAL SLAT FOR CLOSURE BY CURTAIN, AND RESPECTIVE CLOSING CURTAIN

[76] Inventor: Joseph Legeais, 32 Avenue de la Source, Nogent-Sur-Marne, France, 94130

[21] Appl. No.: 242,755

[22] Filed: Oct. 20, 1989

[30] Foreign Application Priority Data

Oct. 28, 1988 [FR] France ..... 88 14160

[51] Int. Cl.[5] ..... E06B 9/00

[52] U.S. Cl. ..... 160/236; 160/201; 160/229.1

[58] Field of Search ..... 160/229.1, 236, 201, 160/232, 235; 16/225, DIG. 13; 312/297; 52/579, 580; 49/464, 198, 501

[56] References Cited

U.S. PATENT DOCUMENTS

| | | | |
|---|---|---|---|
| 2,311,470 | 2/1943 | Ritter | 160/229.1 |
| 2,411,902 | 12/1946 | Skelly | 160/229.1 |
| 2,458,537 | 1/1949 | Skelly | 160/229.1 X |
| 3,062,338 | 11/1962 | Ridder et al. | 52/579 |
| 3,076,500 | 2/1963 | Zoll et al. | 160/236 |
| 3,460,878 | 8/1969 | Peterson et al. | 312/297 |
| 3,814,493 | 6/1974 | Radke | 160/201 X |
| 4,217,012 | 8/1980 | Klaus | 312/297 X |
| 4,413,489 | 11/1983 | Hogue | 312/297 X |
| 4,563,381 | 1/1986 | Woodland | 16/225 X |
| 4,795,206 | 1/1989 | Adams | 160/201 X |
| 4,850,144 | 7/1989 | Grisham et al. | 49/501 X |

FOREIGN PATENT DOCUMENTS

| | | |
|---|---|---|
| 1187160 | 9/1959 | France . |
| 2291340 | 6/1976 | France . |
| 2113749 | 8/1983 | United Kingdom . |

*Primary Examiner*—David M. Purol

*Attorney, Agent, or Firm*—Darby & Darby

[57] ABSTRACT

Two substantially symmetrical half-slats are joined by an integral flexible joint to form a one-piece articulated slat. Adjacent slats rigidly interlock by cooperation of a projecting rib on one slat and a correspondingly shaped groove on the other slat to form an articulated curtain. The flexible joints are bendable in two directions and coextruded with the half-slats.

9 Claims, 1 Drawing Sheet

SECTIONAL SLAT FOR CLOSURE BY CURTAIN, AND RESPECTIVE CLOSING CURTAIN

BACKGROUND OF THE INVENTION

The invention relates to an articulated sectional slat for an articulated curtain and to a closing curtain formed from these slats.

From the document FR-A-2,582,715, it is known how to obtain a curtain closure by means of sectional slats having on a longitudinal edge a male articulation element in closed cylinder form and on the opposite edge a female articulation element in open cylinder form. These two elements are adapted to cooperate with the corresponding elements of the adjacent slats. When the curtain is closed, its front face is substantially flat, and the front edges of two adjacent slats are separated by only a narrow gap.

However, when the slats of the curtain pivot relative to each other, the articulation elements permit a wide spacing between the two front edges of two adjacent slats. As a result, it is impossible to cover the front face of the curtain with a fabric or a decorative paper, which would be torn with the first opening of the curtain.

SUMMARY OF THE INVENTION

It is one of the objects of the present invention to provide a closure curtain with hinged slats, the front face of the curtain having substantially the same surface regardless of the relative position of the slats.

Another object of the invention is to provide curtain slats able to be articulated, forming an angle up to about 60°.

The subject of the present invention is a one-piece sectional slat for a curtain closure comprising two substantially symmetrical half-slats integrally joined by a flexible joint.

The half-slats and the joint are coextruded. Each half-slat presents in cross section a polygonal contour comprising a first side corresponding to the front face of the slat and a second side perpendicular to the first side and corresponding to a lateral face of the slat. The polygonal contour of each half-slat presents, at the joint, an acute angle between the first side and a fourth side. The fourth sides of the two half-slats of one and the same slat forming between them an angle of about 60°.

On each half-slat, the fourth side is separated from a third side by a substantially right angle whose outer wall alone ensures the support of each half-slat on a curtain slide.

The second side of one half-slat has a rib and the second side of the other joined half-slat has a groove so that two adjacent half-slats of two adjacent slats interlock by the cooperation of the rib and groove. The flexible joint presents on its outward face a V-shaped groove whose aperture angle is about 90°.

The invention has as its object also a slat curtain comprising slats rigidly linked together, the articulation occurring in the middle of each slat by means of the flexible joint.

BRIEF DESCRIPTION OF DRAWING

Other characteristics are evident from the description which follows with reference to the annexed drawing in which can be seen.

DESCRIPTION OF THE PREFERRED EMBODIMENTS

Figure 1:
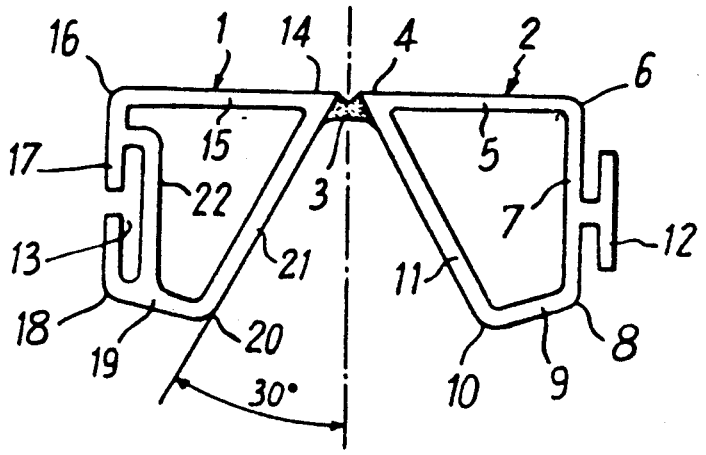
FIG. 1 is a top view of an articulated sectional slat for a curtain closure according to the invention.

Referring to FIG. 1, it is seen that the slat according to the invention includes two half-slats 1, 2 joined by a flexible joint 3. Each half-slat is hollow and obtained, for example, by extrusion of a section of plastic material. Each half-slat presents, in cross section, a polygonal contour presenting an acute angle at the joint 3, that is, toward the middle of the slat.

Starting from this acute angle 4, the polygonal contour of the half-slat 2 has a first side 5 corresponding to the front face of the slat, a right angle 6, a second side 7 corresponding to the lateral face of the slat, an obtuse angle 8, a third side 9, a substantially right angle 10, and a fourth side 11. In this manner, the substantially right angle 10 is the point farthest away from the first side 5. When the curtain moves in a slide, the outer wall of this angle 10 alone ensures the support of the half-slat on the slide, thereby reducing friction On the outside of the half-slat 2, the second side 7 carries a T-shaped rib 12 intended to cooperate with a corresponding groove 13 of the adjacent half-slat, which is identical with the half-slat 1 (FIG. 3).

The half-slat 1 is substantially symmetrical to the half-slat 2 relative to the median plane passing through the joint 3. It presents, in section, a polygonal contour with an acute angle 14, a first side 15, a right angle 16, a second side 17, an obtuse angle 18, a third side 19, a substantially right angle 20, and a fourth side 21. The second side 17 has a T-shaped groove 13, limited in depth toward the interior of the half-slat 1 by a partition 22.

Figure 3:
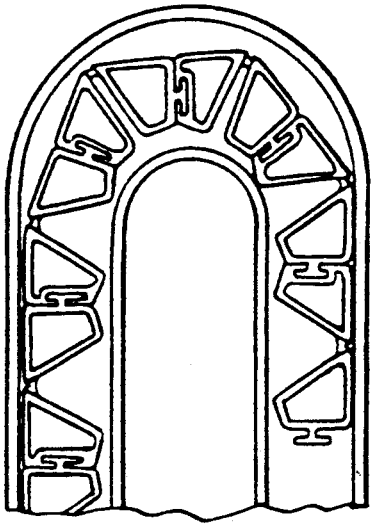
FIG. 3 is a top view of a closing curtain disposed in a slide.

In an assembled curtain, a half-slat 2 interlocks with the adjacent half-slat 1 by insertion of its T-shaped rib 12 in the corresponding T-shaped groove 13 of the adjacent slat (FIG. 3). The slats of the curtain are thus made integral with one another by means of the ribs 12 and grooves 13. The grooves are dimensioned so that the ribs slide in the grooves with a low level of friction. Two adjacent slats thus interlock efficiently and the articulation of the curtain occurs by means of the joints 3, that is, in the middle of the slats. The angle between the two fourth sides 11, 21 of the two half-slats 2, 1, respectively, is about 60°, thus allowing a bending angle of about 60° from one half-slat to the other in the direction that brings the rear corners 10, 20 toward each other.

Figure 2:
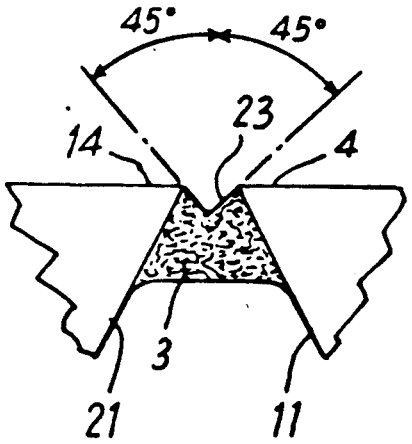
FIG. 2 is an enlarged view of the flexible hinge joint of the slat of FIG, 1.

It is seen in FIG. 2 that the joint 3 is disposed between the two facing sides 11, 21, in the immediate vicinity of the acute angles 4, 14 of the two half-slats. This joint may be effected by glue on the two half-slats, but it is advantageously coextruded with the two half-slats. It is flexible and plastic so as to be elastically deformable.

Preferably the joint 3 presents on the front face of the slat a V-shaped groove 23 whose opening angle is about 90° . This joint 3 permits bending of the slat both backward (FIG. 3) and forward. When the slat is bent backward, the V-shaped groove 23 ensures that the joint does not project forward. In this manner, the entire front face of the curtain can be covered with a fabric or a paper which will not tear in the course of opening or closing of a curtain. The aesthetic appearance of the curtain is thus improved as compared with a conventional curtain with slats articulated on one another by swivel pins that do not permit the placement of a continuous covering.

The curtain according to the invention, consisting of hollow half-slats coextruded with their hinge joint, behaves like a double walled rigid curtain, the flexible joints ensuring the articulation.

As the articulated slats are obtained by coextrusion, they can be cut to the desired length and assembled together to constitute a curtain of given dimensions.

Unlike conventional curtains with slats articulated by link pins, the curtain according to the invention is able to articulate in both directions.

The embodiments illustrated in FIGS. 1 and 2 are only illustrative, and the T-shaped ribs and grooves may be replaced by any type of attachment, for example, with tenon and mortise.

With a slat curtain according to the invention, the noise connected with operation of the curtain is much reduced and very easy operation is noted.

What is claimed:

1. An articulated slat for an articulated curtain comprising two substantially symmetrical half-slats of extended length, said half-slats being integrally connected lengthwise by a flexible joint to form a unitary sectional slat, each said half-slat being a polygon in cross section, said polygon comprising a first side forming a portion of a front face of said slat and a second side perpendicular to said first side and being a lateral face of said slat, and further comprising a third side and fourth side in said polygonal cross section of each said half-slat, said joined half-slats meeting at said joint with an acute angle between the first side and the fourth side of each said half-slat.

2. An articulated slat as in claim 1, wherein said half-slats and said joint are the product of a coextrusion process whereby said half-slats and joint are integral.

3. An articulated slat as in claim 1, wherein the angle between said fourth sides of said joined half-slats is about 60° when said first sides of said half-slats are substantially colinear,

4. An articulated slat as in claim 1, wherein said fourth sides meet said respective third sides with substantially a right angle therebetween.

5. An articulated slat as in claim 1, wherein said flexible joint includes a V-shaped groove, said groove being between said front face portions of said half-slats, the opening angle of said V-shaped groove being about 90°.

6. An articulated slat as in claim 1, wherein said second side of one said half-slat includes a protruding rib and said second side of the other said half-slat includes a correspondingly shaped groove.

7. An articulated slat for an articulated curtain comprising two substantially symmetrical half-slats of extended length, said half-slats being integrally connected lengthwise by a flexible joint to form a unitary sectional slat, each said half-slat being a polygon in cross section, said polygon comprising a first side forming a portion of a front face of said slat and a second side perpendicular to said first side and being a lateral face of said slat, said second side of one said half-slat including a protruding rib and said second side of the other said half-slat including a correspondingly shaped groove, said protruding rib being shaped to be received in said groove with a substantially rigid interlocking by cooperation of said rib and said groove of adjacent slats.

8. An articulated curtain comprising a plurality of slats, said slats being rigidly inked together side to side to form said curtain, each said slat including two substantially symmetrical half-slats of extended length, said half-slats being integrally connected lengthwise by a flexible joint to form said slat, each said half-slat being a polygon in cross section, said polygon comprising a first side forming a portion of a front face of said slat and a second side perpendicular to said first side and being a lateral face of said slat, and further comprising a third side and fourth side in said polygonal cross section of each said half-slat, said joined half-slats meeting at said joint with an acute angle between the first side and the fourth side of each said half-slat.

9. An articulated curtain as in claim 8, wherein said joint is coextruded with said half-slats.

* * * * *